US008001621B2

(12) United States Patent
DiSanto et al.

(10) Patent No.: US 8,001,621 B2
(45) Date of Patent: Aug. 23, 2011

(54) PANTS WITH V-SHAPED WAISTBAND

(75) Inventors: Daniel M. DiSanto, Alameda, CA (US); Stefano Aldighieri, Los Angeles, CA (US)

(73) Assignee: Ariat International, Inc., Union City, CA (US)

( * ) Notice: Subject to any disclaimer, the term of this patent is extended or adjusted under 35 U.S.C. 154(b) by 284 days.

(21) Appl. No.: 12/358,110

(22) Filed: Jan. 22, 2009

(65) Prior Publication Data

US 2010/0180360 A1 Jul. 22, 2010

(51) Int. Cl.
*A41F 9/00* (2006.01)
*A41D 1/06* (2006.01)
*A41D 13/02* (2006.01)

(52) U.S. Cl. ..... 2/236; 2/79; 2/227

(58) Field of Classification Search ..... 2/79, 227, 2/234, 235, 236, 221, 220, 228, 238, 237; 450/132, 133, 134, 135, 140
See application file for complete search history.

(56) References Cited

U.S. PATENT DOCUMENTS

| | | | | | |
|---|---|---|---|---|---|
| 1,288,673 | A | * | 12/1918 | Potterf | 2/70 |
| 1,568,329 | A | * | 1/1926 | Greenberg | 2/236 |
| 2,742,647 | A | * | 4/1956 | Khalil | 2/236 |
| 3,099,266 | A | * | 7/1963 | Spitzer | 450/117 |
| 3,487,473 | A | | 1/1970 | Janhsen | |
| 3,545,446 | A | * | 12/1970 | Nobbs | 450/98 |
| 4,400,832 | A | | 8/1983 | Kinder | |
| 4,523,337 | A | | 6/1985 | Leibowitz | |
| 5,023,957 | A | | 6/1991 | Harvey | |
| 6,243,880 | B1 | * | 6/2001 | Lyden | 2/228 |
| D473,694 | S | | 4/2003 | Lyden | |
| D565,280 | S | | 4/2008 | Nikolayev | |
| D606,284 | S | * | 12/2009 | Caten et al. | D2/742 |
| 2009/0210997 | A1 | * | 8/2009 | Birtch | 2/234 |

* cited by examiner

*Primary Examiner* — Alissa L Hoey
*Assistant Examiner* — Amber Anderson
(74) *Attorney, Agent, or Firm* — Dascenzo Intellectual Property Law, P.C.

(57) ABSTRACT

Pants include a waistband shaped to descend from the hip region to a rear center region, thereby resembling a shallow v-shape. The rear center region is configured to reach toward the back of the individual wearing the pants. A reinforcement patch is used to provide foundation to connect a belt loop to the waistband.

19 Claims, 4 Drawing Sheets

PANTS WITH V-SHAPED WAISTBAND

FIELD OF THE INVENTION

This invention relates generally to apparel. More particularly, this invention relates to pants with a v-shaped waistband for a closer fit to a waist, particularly in the center back region.

BACKGROUND OF THE INVENTION

FIG. 1 illustrates a typical prior art waistband formed from a single rectangular strip of material 100. FIG. 2 illustrates pants 200 with the strip 100 sewn to a pant leg 202, which includes a pocket 204. This prior art pant configuration frequently results in a "back gap", shown by arrow 206. The back gap is the region between the waistband and the back of the individual (not shown) wearing the pants 200. This back gap is particularly apparent when the individual wearing the pants 200 is in a sitting position.

Some pants utilize an elastic waistband to address the back gap problem. Many individuals find elastic waistbands aesthetically unpleasant.

Therefore, it would be desirable to provide a new pant configuration that minimizes back gap, while maintaining aesthetically desirable qualities.

SUMMARY OF THE INVENTION

Pants include a waistband shaped to descend from the hip region to a rear center region, thereby resembling a shallow v-shape. The rear center region is configured to reach toward the back of the individual wearing the pants. In one embodiment, a reinforcement patch is used to provide foundation to connect a belt loop to the waistband.

BRIEF DESCRIPTION OF THE FIGURES

The invention is more fully appreciated in connection with the following detailed description taken in conjunction with the accompanying drawings, in which.

Like reference numerals refer to corresponding parts throughout the several views of the drawings.

DETAILED DESCRIPTION OF THE INVENTION

Figure 1:
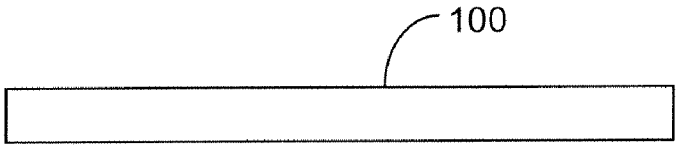
Figure 1 (Prior Art)
FIG. 1 illustrates a rectangular waistband utilized in the prior art.
Figure 2:
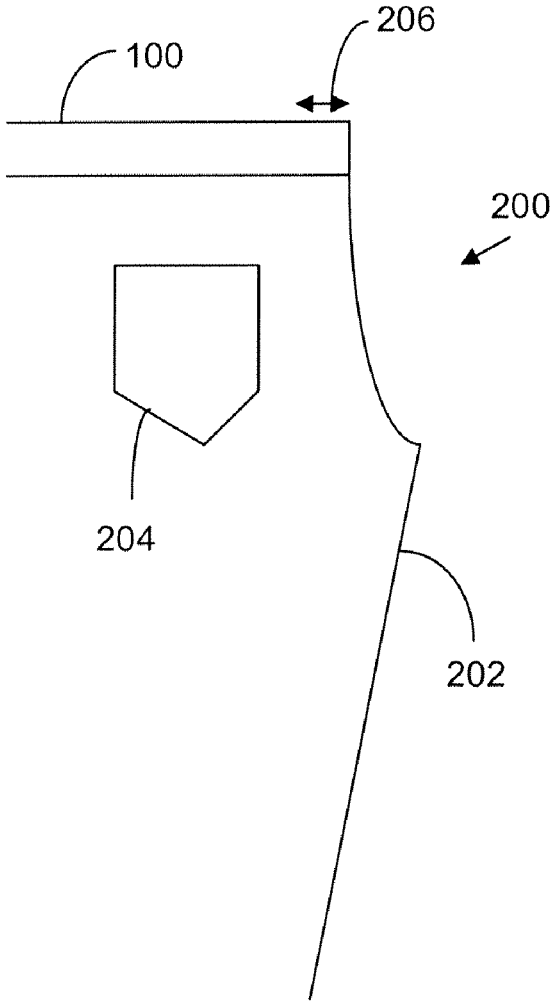
Figure 2 (Prior Art)
FIG. 2 illustrates prior art pants formed with a rectangular waistband.
Figure 3:
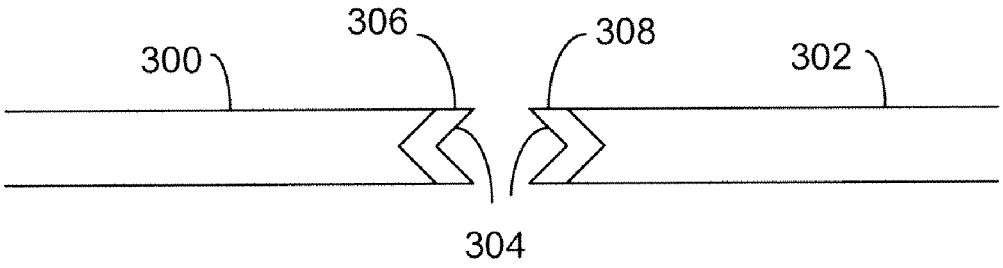
FIG. 3 illustrates two strips of material used to form a v-shaped waistband in accordance with an embodiment of the invention.

FIG. 3 illustrates a first material segment 300 and a second material segment 302. Each material segment has a v-shaped cut-out 304 at a terminal end. The v-shaped cut-out of the first material segment 300 is folded back to form a first v-fold 306. Similarly, the v-shaped cut-out of the second material segment 302 is folded back to form a second v-fold 308.

Figure 4:
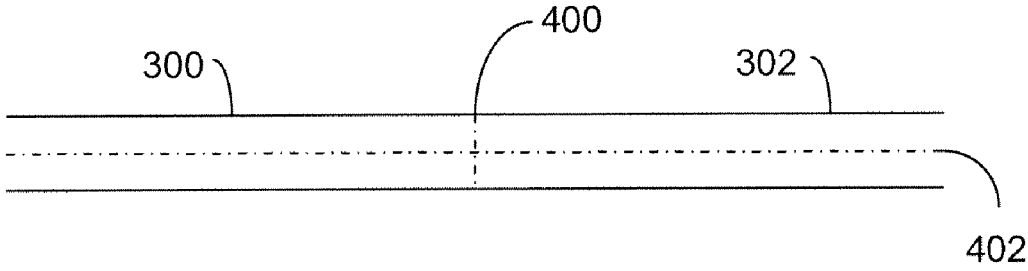
FIG. 4 illustrates the two strips of material from FIG. 3 sewn together; the figure also illustrates a fold line utilized in accordance with an embodiment of the invention.
Figure 5:
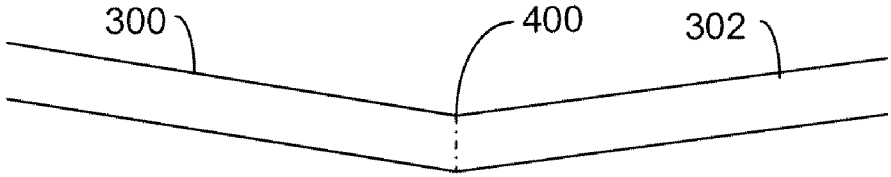
FIG. 5 illustrates the waistband of FIG. 4 after sewing and folding.

The first v-fold 306 and the second v-fold 308 are placed in a face-to-face configuration, which is sewn to form a seam 400, as shown in FIG. 4. FIG. 4 also illustrates a longitudinal axis 402 of the resultant waistband. The waistband is folded along the longitudinal axis 402 to form the waistband of FIG. 5. In particular, FIG. 5 is a rear view of the waistband. Observe that the waistband resembles a shallow v-shape.

Figure 6:
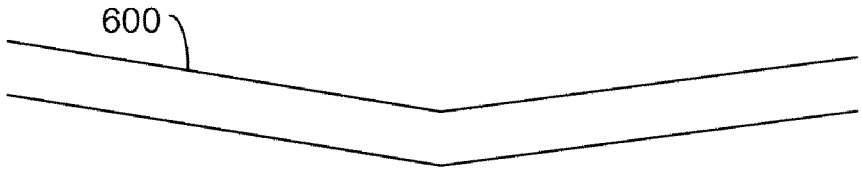
FIG. 6 illustrates a v-shaped waistband formed from a single piece of material in accordance with an embodiment of the invention.

FIG. 6 illustrates an alternate embodiment of the v-shaped waistband. In this embodiment, the material 600 is cut from a single piece of material. The single piece of material may be initially cut to form a shallow v-shape. Alternately, a rectangular strip of material may be used. In this instance, material at the center of the strip is folded and sewn to form the shallow v-shape. The two strip embodiment of FIG. 3 has the advantage of using smaller pieces of material, which may be cut from a base material in a more efficient manner to reduce material waste.

Figure 7:
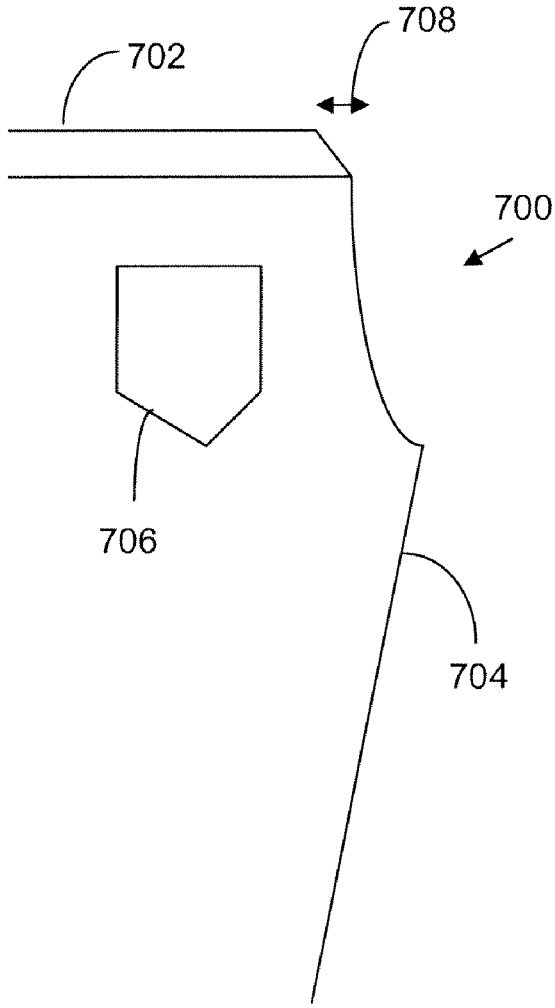
FIG. 7 is a side view of pants with a v-shaped waistband in accordance with an embodiment of the invention.

FIG. 7 is a side view of pants 700 formed in accordance with an embodiment of the invention. The figure illustrates a waistband 702, such as the waistband of FIG. 5 or FIG. 6, attached to a pant leg 704, which includes a pocket 706. Arrow 708 indicates an eliminated or reduced back gap region. In particular, the rear center region reaches toward the back of the individual (not shown) wearing the pants. The disclosed waistband results in a configuration where the top of the waistband has a slightly smaller circumference than the remainder of the waistband, thereby promoting closer engagement with the back of the individual at the top of the waistband.

Figure 8:
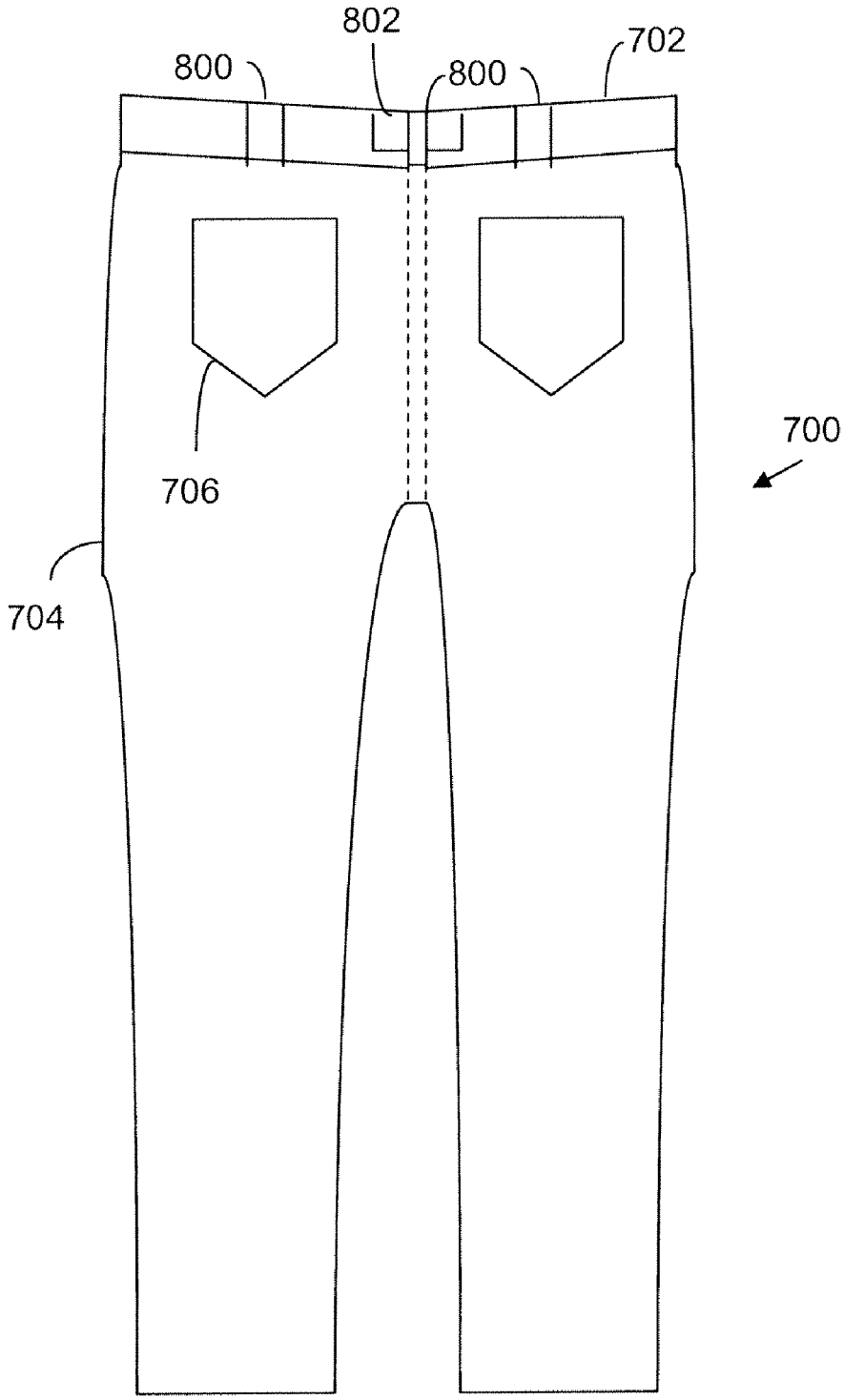
FIG. 8 is a rear view of pants with a v-shaped waistband in accordance with an embodiment of the invention.

FIG. 8 is a rear view of pants 700. Observe that the waistband 702 has a subtle v-shape descending from the hip region to the rear center region. When the pants are worn by an individual, the natural shape of the body tends to diminish the observable nature of the v-shape. Thus, an individual enjoys a reduced back gap with a contoured fit. At that same time, when worn on a body, the v-shape is barely observable, thereby creating the aesthetic appeal of a straight waistband. Another benefit of the waistband 702 is that the shape tends to align the grains of the fabric (e.g., denim) in a vertical manner.

FIG. 8 also illustrates a set of belt loops 800. In one embodiment, one or more belt loops 800 includes a reinforcement patch 802. The reinforcement patch is a piece of fabric that is attached to the front and/or back of the waistband. The top and/or bottom of the belt loop 800 is sewn to the reinforcement patch 802. The reinforcement patch provides more foundation for stitching and thereby anchors the belt loop 800 in a more secure manner. Accordingly, the belt loop 800 is harder to tear away This embodiment is particularly useful for rodeo ropers. The reinforcement patch reduces wear, tear and ripping of a belt loop when a rope is pulled in and out of the loop.

The reinforcement patch may be formed of leather, faux leather, suede or denim. The pants may also be formed from one or more of the same materials.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. Pants, comprising:

a waistband shaped to descend from the hip region to a rear center region, thereby resembling a shallow v-shape, wherein the rear center region is configured to reach toward the back of the individual wearing the pants;

wherein the waistband includes a fold that defines an upper edge of the waistband, and wherein the waistband further includes a seam that defines an apex of the shallow v-shape wherein the waistband is formed with a first segment having a first terminal end and a second segment having a second terminal end, wherein the first terminal end is sewn to the second terminal end to form the seam, and further wherein the first terminal end of the first segment is v-shaped and the second terminal end of the second segment is v-shaped when the waistband is unfolded at the fold.

2. The pants of claim 1 wherein the fold forms a waistband circumference smaller than the remainder of the waistband circumference.

3. The pants of claim 1 wherein the waistband is folded in half along a longitudinal axis to form the fold.

4. The pants of claim 1 wherein the waistband is formed from a single straight piece of material with an overlapping and sewn region at its center to form the shallow v-shape.

5. The pants of claim 1 further comprising at least one belt loop connected to the waistband, and at least one reinforcement patch positioned over the waistband, wherein the at least one belt loop is attached to the at least one reinforcement patch positioned over the waistband.

6. The pants of claim 5 wherein the at least one reinforcement patch is formed from a material selected from leather, faux leather, suede and denim.

7. The pants of claim 5, wherein the at least one reinforcement patch is positioned over only a portion of the waistband proximate where the at least one belt loop is connected to the waistband.

8. The pants of claim 7, wherein the at least one reinforcement patch is configured to provide a foundation for stitching of the at least one belt loop to the waistband and to increase the strength by which the belt loop is anchored to the waistband.

9. The pants of claim 1 wherein the pants are formed from denim.

10. The pants of claim 9, wherein the denim has a grain, and further wherein when worn by the individual, the waistband vertically aligns the grain of the denim.

11. The pants of claim 1 wherein the waistband is non-elastic.

12. The pants of claim 1 wherein the waistband is folded in half along a longitudinal axis to form the fold.

13. The pants of claim 1, wherein the first and the second segments respectively include first and second segment folds that define the first and the second v-shaped terminal ends.

14. Reduced back gap pants, comprising:

a pants body having a pair of elongate pant legs;

a non-elastic waistband shaped to descend from the hip region to a rear center region, thereby resembling a shallow v-shape, wherein the rear center region is configured to reach toward the back of the individual wearing the pants, wherein the waistband is folded along a longitudinal axis to form a fold that defines an upper edge of the waistband to form a waistband circumference that is smaller than the remainder of the waistband circumference and a seam that defines an apex of the shallow v-shape; and further wherein the waistband is formed with a first segment having a first terminal end and a second segment having a second terminal end that is sewn to the first terminal end to form the seam wherein the first terminal end of the first segment is v-shaped and the second terminal end of the second segment is v-shaped when the waistband is unfolded at the fold.

15. The pants of claim 14, wherein the pants are formed from denim.

16. The pants of claim 15, further comprising a belt loop connected to the waistband and a reinforcement patch positioned over only a portion of the waistband proximate where the belt loop is connected to the waistband, wherein the belt loop is attached to the reinforcement patch, and further wherein the reinforcement patch is configured to provide foundation for stitching of the belt loop to the waistband and to increase the strength by which the belt loop is anchored to the waistband.

17. The pants of claim 16, wherein the reinforcement patch is formed from a material selected from leather, faux leather, suede and denim.

18. The pants of claim 16, wherein the belt loop and the reinforcement patch are secured to a rear portion of the waistband.

19. The pants of claim 14, wherein the first and the second segments respectively include first and second segment folds that define the first and the second v-shaped terminal ends.

* * * * *

UNITED STATES PATENT AND TRADEMARK OFFICE

CERTIFICATE OF CORRECTION

PATENT NO. : 8,001,621 B2
APPLICATION NO. : 12/358110
DATED : August 23, 2011
INVENTOR(S) : Daniel DiSanto and Stefano Aldighieri It is certified that error appears in the above-identified patent and that said Letters Patent is hereby corrected as shown below:

On page 7, Column 3, Line 37, after "patch" please delete "positioned over the waistband".

Signed and Sealed this
Eleventh Day of October, 2011

David J. Kappos

David J. Kappos
*Director of the United States Patent and Trademark Office*